US010058894B2

(12) United States Patent
Czech

(10) Patent No.: US 10,058,894 B2
(45) Date of Patent: Aug. 28, 2018

(54) DEVICE FOR CLEANING AND FINE-SORTING GRAIN METALLURGICAL WASTE FINES AND METHOD FOR CLEANING AND FINE-SORTING GRAIN METALLURGICAL WASTE FINES

(71) Applicant: Przedsiębiorstwo Obrotu Surowcami Wtórnymi "HERMEX" Adam Czech, Herby (PL)

(72) Inventor: Adam Czech, Herby (PL)

(73) Assignee: PRZEDSIEBIORSTWO OBROTU SUROWCAMI WTORNYMI HERMEX ADAM CZECH, Herby (PL)

( * ) Notice: Subject to any disclaimer, the term of this patent is extended or adjusted under 35 U.S.C. 154(b) by 0 days.

(21) Appl. No.: 15/038,943

(22) PCT Filed: Nov. 25, 2014

(86) PCT No.: PCT/PL2014/000136

§ 371 (c)(1),
(2) Date: May 24, 2016

(87) PCT Pub. No.: WO2015/080608

PCT Pub. Date: Jun. 4, 2015

(65) Prior Publication Data

US 2017/0021392 A1 Jan. 26, 2017

(30) Foreign Application Priority Data

Nov. 26, 2013 (PL) ..... 406250

(51) Int. Cl.
*B07B 9/02* (2006.01)
*B07B 4/04* (2006.01)
(Continued)

(52) U.S. Cl.
CPC ..... *B07B 9/02* (2013.01); *B03C 1/30* (2013.01); *B04C 5/04* (2013.01); *B07B 4/04* (2013.01);
(Continued)

(58) Field of Classification Search
CPC .... B07B 4/02; B07B 4/04; B07B 7/02; B07B 7/04; B07B 7/06; B07B 9/00; B07B 9/02; B07B 11/06; B03C 1/30
See application file for complete search history.

(56) References Cited

U.S. PATENT DOCUMENTS 1,861,248 A 5/1932 Stebbins
4,477,269 A * 10/1984 Laughlin ..... B01D 46/26 55/290

(Continued)

FOREIGN PATENT DOCUMENTS

DE 102008040100 A1 1/2010
DE 102008040100 A1 1/2010

(Continued)

*Primary Examiner* — Joseph C Rodriguez
(74) *Attorney, Agent, or Firm* — Horst M. Kasper, Esq.

(57) ABSTRACT

A device for cleaning and fine-sorting grain metallurgical waste fines and the method for cleaning and fine-sorting grain metallurgical waste fines. The material is fed to the device for cleaning of fine metallurgical waste from the feeding tank (1), by means of a feeding mechanism (2) and is transported to initial separator (3), into which air is blown with a fan (4). The most dusty fractions hovering in the initial separator (3) are directed to the collector (6). However, the largest fractions of metallurgical waste fall to the bottom part, and they are removed with a cascade pipeline (7) directed upwards to the cascade separator (8). Lighter fractions accumulated in the cascade separator (8), are directed to the collector (6), and then to the next cascade separator (15), from where lighter and finer fractions of metallurgical waste are directed to expanded cascade sepa-
(Continued)

rator (16), and the lightest fraction of waste are then directed to the cyclone dust collector (18).

16 Claims, 2 Drawing Sheets

(51) Int. Cl.

| | |
|---|---|
| ***B07B 7/02*** | (2006.01) |
| ***B07B 7/04*** | (2006.01) |
| ***B07B 11/04*** | (2006.01) |
| ***B03C 1/30*** | (2006.01) |
| ***B04C 5/04*** | (2006.01) |

(52) U.S. Cl.
CPC ..... *B07B 7/02* (2013.01); *B07B 7/04* (2013.01); *B07B 11/04* (2013.01)

(56) References Cited

U.S. PATENT DOCUMENTS 5,392,998 A * 2/1995 Suessegger ..... B02C 21/00 209/143
5,505,389 A * 4/1996 Sussegger ..... B02C 21/005 241/152.2
6,695,911 B2 * 2/2004 Ramesohl ..... B02C 4/02 106/745
6,845,867 B2 * 1/2005 Sussegger ..... B07B 4/04 209/135
6,953,517 B1 * 10/2005 Boretzky ..... B03B 9/04 110/259
7,300,007 B2 * 11/2007 Hagedorn ..... B02C 4/02 209/143
7,712,611 B2 * 5/2010 Longhurst ..... B07B 4/04 209/137
8,016,117 B2 * 9/2011 Althouse ..... B07B 4/02 209/139.1
8,210,458 B2 * 7/2012 Strasser ..... B02C 4/02 241/135
8,267,254 B2 * 9/2012 Cox ..... B07B 4/02 209/139.1
2005/0029166 A1 * 2/2005 Schumacher ..... A24C 5/396 209/356
2008/0023374 A1 1/2008 Martin
2014/0306044 A1 * 10/2014 Guenter ..... B07B 4/04 241/42
2015/0108041 A1 * 4/2015 Andersen ..... B07B 9/02 209/3.1
2015/0165394 A1 * 6/2015 Leininger ..... B01F 11/0094 241/98
2015/0258576 A1 * 9/2015 Hagemeier ..... B07B 4/02 241/61

FOREIGN PATENT DOCUMENTS

PL 395273 A1 12/2012
PL 395273 A1 12/2012

* cited by examiner

DEVICE FOR CLEANING AND FINE-SORTING GRAIN METALLURGICAL WASTE FINES AND METHOD FOR CLEANING AND FINE-SORTING GRAIN METALLURGICAL WASTE FINES

The subject of this invention is an apparatus for cleaning and grain sorting fine metallurgical waste material. The apparatus is intended for separation and cleaning loose substances, fine or reduced in size, which are contained in dusts and powders. The finest metallurgical waste material, in the form of dusts and powders, for example those produced after processing of melting loss in ball mills, contains fine grains of valuable metal, the recovery of which is technologically difficult.

The subject of this invention is also the method for cleaning and grain sorting fine metallurgical waste material.

The differences in physical properties of loose materials are used for separation and cleaning in the process of flow classification. The size of grains, their mass and density as well as hardness, grindability and impact strength are of great importance. In the flow apparatus the influence of air stream causes diverse behaviour of materials with different mass and grain sizes. When the air stream has low velocity, material with big mass reduces its speed which causes its precipitation and sedimentation of its particles, while material with less mass still remains in the stream of flowing air. With higher flow velocity and due to the change of stream direction the particles of material collide each other and affect the constructional elements of the apparatus, resulting in material breaking and cleaning.

Thus far various apparatus for separation of grains are known, including in particular various sieve shakers and cascade flow classifiers, described in subject literature [„Skrypt uczelniany. Maszynoznawstwo odlewnicze/University Textbook. Theory of Casting Machines. A. Fedoryszyn, K. Smykasy, E. Ziółkowski. Uczelniane Wydawnictwo Naukowo-Dydaktyczne, Kraków 2008, p. 36 and 37]. The assembly of known cascade classifier consists of the set of segments, arranged in the cascade, with partitions located inside the segments.

The grains of fed materials are being separated as a result of the flow of air, supplied by a connector pipe. Fed material is supplied to the classifier from a tank, by means of a feeding screw. The products of separation are collected in a cyclone, placed in the upper part of the classifier (fine-grained product) and in a container placed under the outlet, in the lower part of the separator (coarse-grained product). The air from the cyclone is discharged, through a duct, to the fabric filter and extraction fan.

The "Apparatus for selective separation of coarse-grained fractions from polyfractional material with wide range of grain-size distribution" is known from the Polish description of patent application no. P-312403 (publication in BUP No. 15/1997). This invention resolves the issue if selective separation of coarse-grained fractions from polyfractional material with wide range of grain-size distribution. The apparatus consists of a flow duct built of external segments, in the form of truncated cones joined with bases. The pouring inserts are fixed inside of the segments. Polyfractional material flows gravitationally in the counter-current to the separating gas. An additional duct for separating gas supply, along with a valve, is placed in the upper part of the apparatus.

Another solution is known from the American patent description no. US2008023374, titled "Method and apparatus for separating residues". It presents the apparatus for separating the residues from heat treatment into various fractions. This apparatus consists of a casing seated on self-aligning elements and fitted with several plates mounted inside and placed obliquely, one above another. The apparatus is fitted with vibrating elements, causing that separated material falls down from individual plates.

Another solution is presented in Japanese patent description no. JP53124192, titled "Method and apparatus for classifying and recovering granulated slag". In this apparatus the individual fractions are separated by means of gases.

The Polish description of patent application no. P-395273, titled "Apparatus for cleaning and separating fine metallurgical waste material and method for cleaning and grain classification of fine metallurgical waste material" presents the apparatus equipped with vertically arranged cascade separator, inside of which the overpressure is produced. The separated material is transported by air stream, through the pipe for pneumatic transport, ended with a nozzle narrowing downwards and a breaking bumper located opposite to the nozzle outlet, to the separator's cleaning and separating column. Cleaned coarse-grained material is carried away through the lower outlet to the magnetic separator, where it is separated into fractions and directed to the outlet of magnetic fraction or to the outlet of non-magnetic fraction.

The purpose of invention is to develop an apparatus for separating and cleaning loose materials, which would be more efficient than the solutions known so far and additionally allow the separation of material into several fractions with various grain sizes, weight and other physical and chemical properties. The purpose of invention is also the development of method for recovering such types of fractions.

Developed separator for cleaning and grain sorting of fine metallurgical waste material consists of the feeding tank connected, by the loose material feeder, with vertically oriented initial separator. The air is blown by fan into the initial separator. The lower part of initial separator is connected, by an ascending pipeline, with the cascade separator. A bumper with cascades located over and under it, is installed in the central part of the cascade separator. These cascades are arranged obliquely and in some intervals from each other. A regulation damper, through which the accumulating heavier fractions of cleaned material are discharged to the magnetic separator and then to the external tank, or directly to the external tank, is located in the lower part of the cascade separator. The upper part of described cascade separator is connected with a filter, into which the lighter, floating fractions of cleaned fine metallurgical material, are introduced. The end part of the apparatus is the outlet, which can be connected with a fan or suction pump. The essence of developed solution is that the ascending pipeline is a cascade pipeline, and individual sections of this cascade pipeline have different diameter or they are arranged out-of-alignment or equipped with cascades, or they are spirally shaped.

Preferably, both the upper part of the initial separator and the upper part of the cascade separator are connected, by ducts, with the collector. The lightest, dusty fractions, separated in the initial separator and cascade separator are introduced to the collector, from where they are directed to the next cascade separator, connected with the collector. There is a regulation damper in the lower part of the next cascade separator and the air is sucked through this damper which causes that the finest fractions of material are raised upwards. The next, thicker fraction of separated metallurgical waste material is introduced through this damper and it is dumped, preferably to the magnetic separator and then to the external tank or directly to the external tank.

Preferably, the next cascade separator is connected with the expanded cascade separator, in the upper part of which there is a zone of adjustable vertical cascades. These vertical cascades form a kind of shutter and the inclination angle of this shutter can be appropriately adjusted. The stream of cleaned, fine metallurgical waste material, which is introduced to the expanded cascade separator from the next cascade separator, lands on this shutter.

Preferably, the cyclone dust collector is connected with the expanded cascade separator. From the expanded cascade separator the stream of fine waste material is introduced into the cyclone dust collector. There is a regulation damper in the lower part of the cyclone dust collector. Through this damper additional air can be sucked from outside and heavier fractions of waste material are discharged to the magnetic separator and external tank, or directly to the external tank.

Preferably, the separator for cleaning fine metallurgical waste material is equipped with at least one additional separator, preferably the cascade separator or additional cyclone dust collector.

The developed method for cleaning and grain sorting of fine metallurgical waste material consists in that the loose waste material is transported, by means of a feeder, from the feeding tank to a vertically oriented initial separator, preferably of cascade type, operating on the principles known so far, and simultaneously the air is blown into the initial separator by fan, preferably through a regulation damper. Then the overpressure is produced inside of the initial separator, giving the velocity to the particles of material, and then the loose material is "blown through", which causes that the thickest fractions fall onto the bottom of initial separator, from where they are directed into the cascade separator, directly onto the bumper and the cascades located over and below it, where the grains are separated. The heaviest grains, that fall downwards, are discharged through the regulation damper, preferably to the magnetic separator, or directly to the external tank, while the fine grains floating in the air are carried away through the outlet. What is characteristic for this method, the initially separated material collected on the bottom of initial separator is moved with the air stream to the cascade separator, through a cascade pipeline, in which the cleaned and separated material gets broken and is crumbled against its walls.

Preferably, the most dusty fractions separated in the initial separator and also in the cascade separator, which raise up with the air, are directed to the collector, and then into the next separator, where this material is dispersed and additionally broken and its lightest, unwanted fractions are sucked up the separator. The heaviest, cleaned and coarse-grained fractions, that slide down, are discharged, preferably, to the magnetic separator and then to the external tank, or directly to the external tank.

Preferably, the most dusty fractions separated in the next separator, that raise up with the air, are directed to the expanded cascade separator, where the stream is directed to the zone of regulated cascades, which form a shutter. The inclination angle of this shutter can be appropriately adjusted. Then the heavier, separated fractions of material, which moved downwards, are discharged similarly through the regulation damper, preferably to the magnetic separator or directly to the external tank.

Preferably, the floating lightest fractions of waste material are directed from the expanded cascade separator to the cyclone dust collector, from where they are, through the regulation damper, introduced, preferably to the magnetic separator, or directly to the external tank, as the next fraction of separated metallurgical waste material, and during the operation of the cyclone dust collector the regulation damper remains, preferably closed.

Very fine waste material, including the fractions of fine aluminium melting loss, containing metallic aluminium, metal oxides and metal salts, can be processed in the developed separator for cleaning fine metallurgical waste material. As the fine, segregated metallurgical waste materials are moved in the developed apparatus, the materials with different grain size, mass and physical and chemical properties are separated very efficiently. The segregation of waste material and division into individual fractions also take place here. For example, as it results from conducted experiments, in the developed apparatus, in which the method described for the invention is applied, about 150-400 kg of material (from 15 to 40%) is obtained from one ton of broken up aluminium melting loss, and after magnetic separation this material can be used for melting of aluminium alloys or aluminium defined as so-called "secondary" aluminium. Obtained material can be also used as deoxidizer in metallurgical processes. Some of material fractions obtained in described process, which contain less than 40% of metal, can be also used as deoxidizers and insulating or exothermic casting powders in steel metallurgy process and in casting of metals. Obtained material, containing less than 10% of metallic aluminium, can be used for production of synthetic slags for steel refining and as an additive for slag fluxing in steel-making processes.

Figure 1:
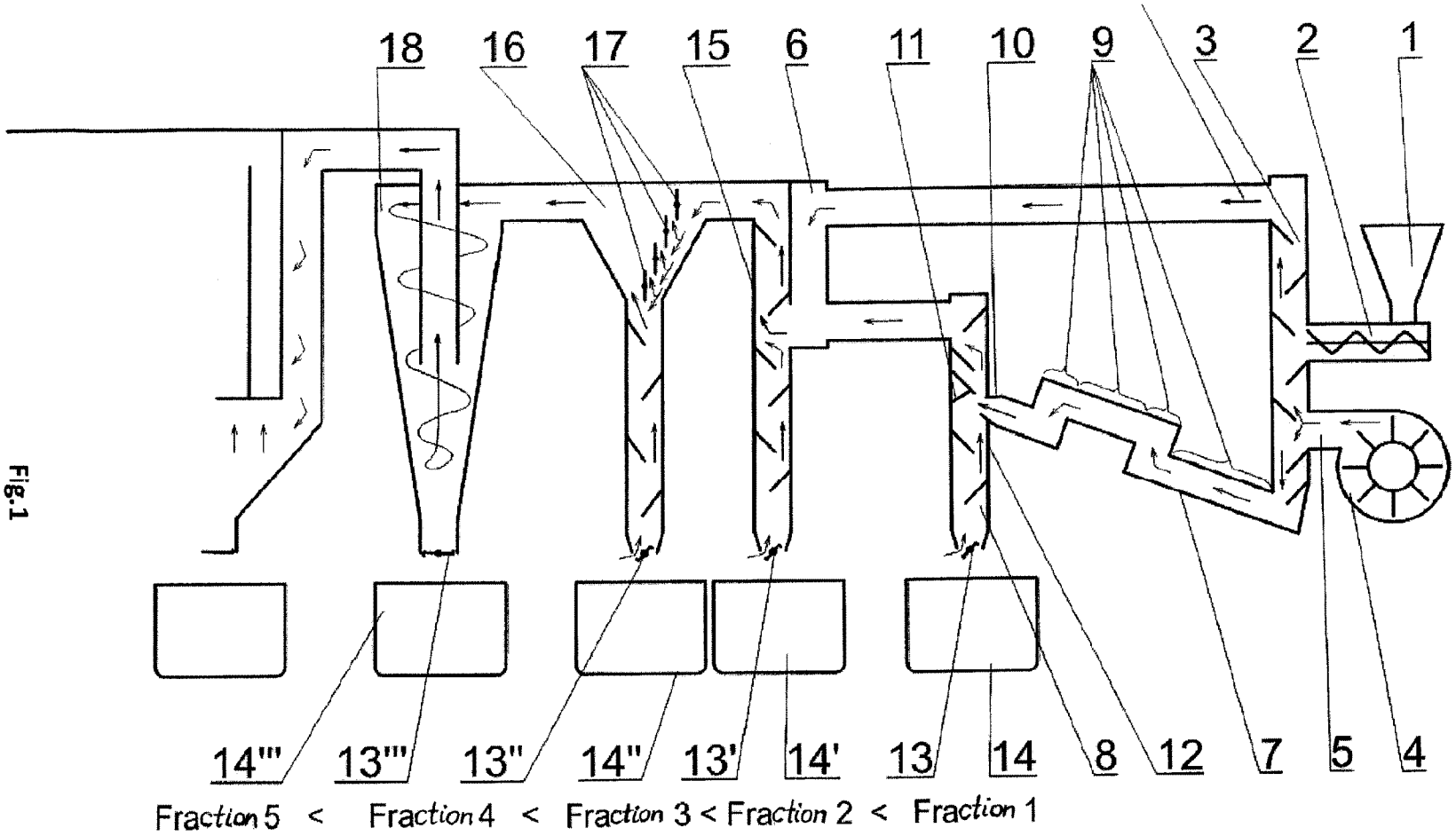
FIG. 1 presents the scheme of a separator for cleaning fine metallurgical waste material.
Figure 2:
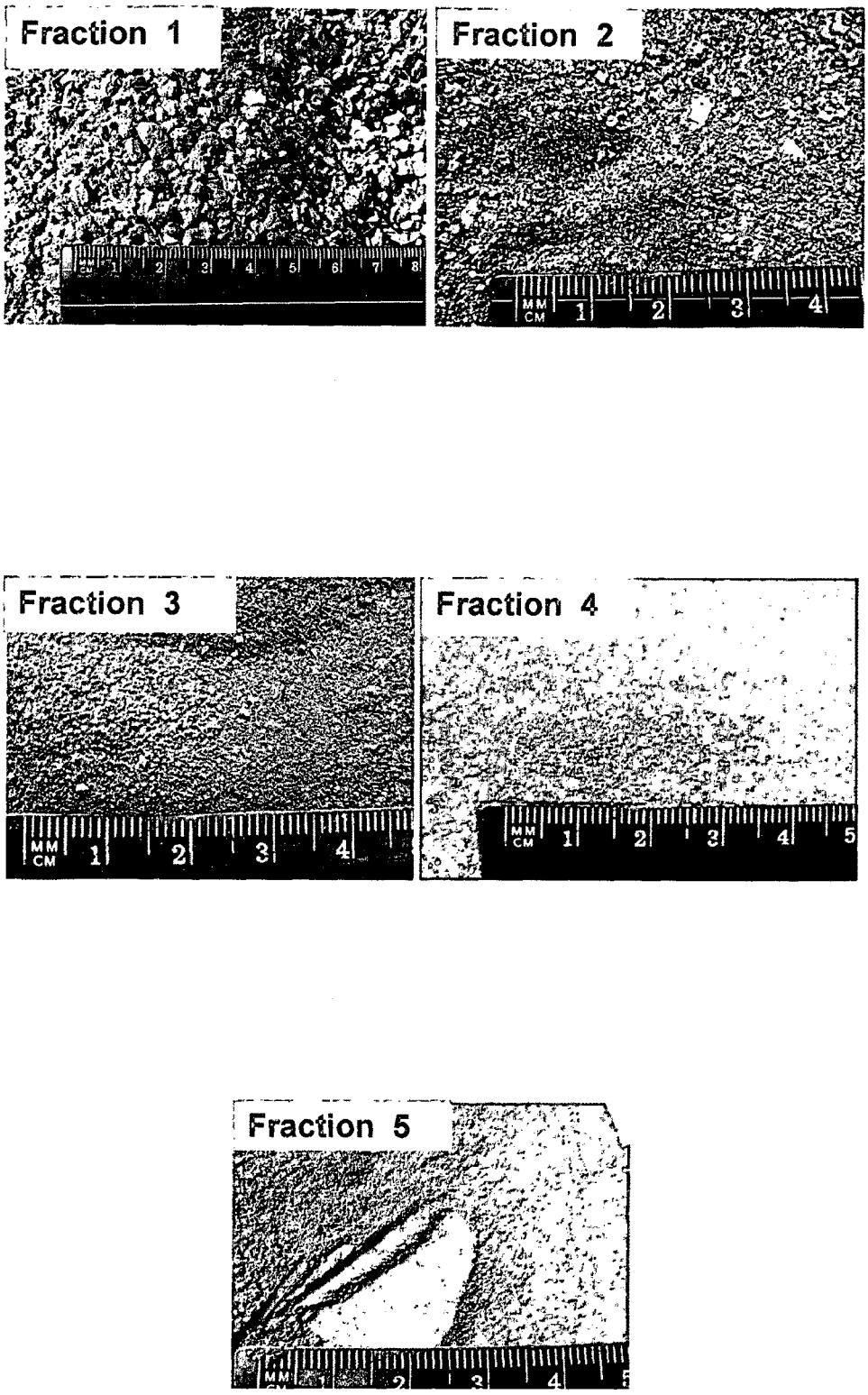
FIG. 2 presents various fraction sizes at various phases in the separation process.

As shown in the drawing, a loose material, usually with diameter below 5 mm, is fed, through the feeding tank 1, to the developed separator for cleaning fine metallurgical waste material. By means of the loose material feeder 2 (e.g. screw or bucket feeder, etc.) this loose material is moved to the vertically oriented initial separator 3, preferably of cascade type, which operates on the principles known so far. The air is blown into the initial separator 3 by the fan 4, preferably through the regulation damper 5, producing overpressure inside of initial separator 3 and giving velocity to the particles of initially cleaned and separated material. The most dusty fractions, which raise up along with the air in the initial separator 3 are discharged to the collector 6, while the thickest fractions of metallurgical waste material, due to gravity and their own weight, fall down to its lower part, from where they are carried away, by an ascending cascade pipeline 7, to the cascade separator 8. However individual sections 9 of the cascade pipeline 7 are of various diameters or are not arranged coaxially or are equipped with cascades or may be spirally shaped, so that during transportation of preselected material, its flow is disturbed and the fractions—usually the heaviest ones—change the direction of movement, which additionally facilitates breaking and cleaning of the grain surface. The operation [principle of the cascade pipeline 7 consists in change of movement trajectory of the particles transported pneumatically in a two-phase stream, ending preferably with nozzle 10, which increases flow rate of the preselected material, which may undergo further technological operations. The waste transported upstream the cascade pipeline 7 are directed to bumper 11 in the cascade separator 8 and then come across cascades 12 located above and under the bumper, consequently the material is additionally refined and dispersed and the efficiency of grain separation and cleaning is increased. Whereby the cascades 12 are arranged askew, in certain distance from each other, they are inclined downwards, and vertically they overlap, so to say. The material to be cleaned is introduced to cascade separator 8 and is poured on the cascades 12 downwards, being blown through, and while the largest fractions fall down to the bottom of the cascade separator 8 due to gravity and their own weight, the lighter fractions move upwards. So to say "On their way up" the fractions come across cascades 12, that additionally obstruct the movement up of the heavier grain and thus support separation of larger fractions. The larger fractions that accumulate at the bottom of the cascade separator 8 are removed by means of regulation damper 13, through which the air is sucked in and the smallest fractions of material are lifted up. Through the regulation damper 13 the fine grained material is moved, preferably to a magnetic separator, or directly to the external tank 14. On the other hand, the lighter fractions moving upwards and collected in cascade separator 8 are directed to the collector 6 and then to the next cascade separator 15, where the cleaning process is analogical to cascade separator 8. From the cascade separator 8, analogically, through a regulation damper 13" next fraction, of determined grain size and weight, is collected, preferably to a magnetic separator, or directly to the external tank 14".

Whereas the lighter and finer fractions of the metallurgical waste, that are isolated as described above, are directed to expanded cascade separator 16, where the stream hits the area of adjustable, basically vertical cascades 17, creating a shutter, so to say, the angle of which may be additionally adjusted. The adjustable cascades 17 overlap and they are arranged basically vertically, and the material directed at them hits them and slides down from one cascade onto another, lower cascade, and finally the largest fractions find their way to the main column of the expanded cascade separator 16. Analogically, the largest fraction is removed through a regulation damper 13" preferably to a magnetic separator, or directly to the external tank 14", whereas the lightest, hovering fractions are directed to the cyclone dust collector 18.

The material directed to the cyclone dust collector 18 goes inside tangentially to the internal walls of the conical housing of the cyclone dust collector 18, which causes the whirl of material and subjects the material to centrifugal force. Consequently, lighter fractions concentrate on the walls and slide down, where they are removed analogically through a regulation damper 13" directly to the external tank 14' as a next fraction of material, whereas the regulation damper 13'" during operation of cyclone dust collector is preferably closed. The lightest, dust fractions—isolated during the described process, carried out on cooperating and arranged in series separators, creating an assembly that may be developed to include greater quantity of separators (depending on the number of fractions and the physical and chemical properties of the material we want to obtain), at the end of such assembly there is a cyclone dust collector 18—and the lightest fractions are sucked from the middle part of the cyclone dust collector 18 and are introduced to the filter 19, preferably a jet filter. And at the outlet 20, through which clean air is let outside, possibly additional negative pressure is created by means of fans or suction pumps 21. The remaining dust is collected, as the most isolated and lightest fraction of the cleaned material, in the external tank 14"".

LIST OF ELEMENTS

1—feeding tank,
2—feeding mechanism,
3—initial cascade separator,
4—fan,
5—damper,
6—collector,
7—cascade pipeline,
8—cascade separator,
9—section (of a pipeline),
10—nozzle,
11—bumper,
12—cascade,
13—regulation valve/damper,
14—external tank,
15—next cascade separator,
16—expanded cascade separator,
17—adjustable cascade,
18—cyclone dust collector,
19—filter,
20—outlet (of air),
21—suction pump.

The invention claimed is:

1. A device for sorting fine metallurgical waste in the form of loose material, composed of a feeding tank connected to a feeding mechanism for the loose material, with a vertically oriented initial separator, into which air is blown by a means of a fan, and with a bottom part connected by a means of an ascending pipeline with a cascade separator, wherein in a middle part of the cascade separator there is a bumper with cascades located above and under the bumper, wherein the cascades are arranged askew and in a certain distance from each other, whilst in the bottom part of the cascade separator there is a regulation damper, through which larger fractions of a cleaned loose material are discharged to a magnetic separator and later to an external tank or directly to the external tank, wherein an upper part of the described cascade separator is connected to a filter, into which a lighter, hovering fractions of the cleaned loose material are introduced, and an end element of the device is an outlet connected with a fan or a suction pump, wherein the ascending pipeline is a cascade pipeline (7), wherein individual sections (9) of the cascade pipeline (7) are of a different diameter or are not arranged coaxially or are equipped with cascades or are of spiral shape.

2. The device according to claim 1, wherein both the upper part of the initial separator (3) and the upper part of the cascade separator (8) are connected by means of ducts to a collector (6), into which lightest, dusty fractions of the loose material, isolated in the initial separator (3) and in the cascade separator (8), wherein the lightest fractions of the loose material are then directed to another cascade separator (15), wherein there is a regulation damper (13) located in its bottom part, by means of which the air is sucked in and the finest fractions of the loose material are lifted up; wherein by a means of the damper (13) a coarser fraction of the loose material is introduced and poured to the magnetic separator and then to the external tank (14'), or directly to the external tank (14').

3. The device according to claim 2, wherein another cascade separator (15) is connected to an expanded cascade separator (16), which contains an area of adjustable vertical cascades (17), creating a shutter, whose an angle can be adjusted, wherein a stream of the loose material is introduced to the expanded cascade separator (16) from another cascade separator (15) goes to the shutter.

4. The device according to claim 3, wherein the cascade separator (16) is connected to a cyclone dust collector (18), into which a stream of the loose material is introduced from the expanded cascade separator (16), wherein a regulation valve (13''') is located on the bottom of the cyclone dust collector, through which the additional air can be sucked from outside and through which larger fractions of the loose material are removed to a magnetic separator and to an external tank (14'''), or directly to the external tank (14''').

5. The device according to claim 1, wherein the device is equipped with at least one additional separator, in the form of an additional cascade separator or with an additional cyclone dust collector (18).

6. A method for cleaning and fine-sorting grain metallurgical waste fines in the form of loose material that consists of feeding a loose waste material from a feeding tank by means of a feeding mechanism to a vertically oriented initial separator, in the form of a cascade separator, blowing simultaneously air with a fan to the inside of the initial separator through a regulation damper, creating a positive pressure, or an overpressure inside the initial separator, speeding up particles of the loose material, purging the loose material, causing the largest fractions of the loose material to fall down to a bottom of the initial separator, directing the largest fractions of the loose material to the inside of the cascade separator, directly to a bumper and cascades located under and over the bumper, selecting of heaviest grains of the loose material, removing the heaviest grains of the loose material that fell down by means of the regulation damper, in the form of a magnetic separator where are separated into fractions and directed to the outlet of magnetic fraction or to the outlet of non-magnetic fractions, or directly to an external tank, removing the finest particles of the loose material, lifted up with the air through an outlet, moving a preselected loose material, accumulated on a bottom of the initial separator (3) by a stream of the air to a cascade separator (8) through a cascade pipeline (7), breading up and crumbling the cleaned and separated loose material against walls of the cascade pipeline (7).

7. The method according to claim 6, further consisting of directing the most dusty fractions of the loose material isolated in the initial separator (3), as well as in the cascade separator (8), lifted up with the air to the collector (6), directing next the most dusty fractions of the loose material to another separator (15), dispersing and additionally breaking up the loose material, sucking up the lightest undesirable fractions of the loose material to the top of the separator, sliding down of the largest cleaned coarsegrained fractions of the loose material to the magnetic separator, sliding down of the largest cleaned coarsegrained fractions of the loose material to the external tank (14'), or directly to the external tank (14') omitting magnetic separator.

8. The method according to claim 7, further consisting of isolating the most dusty fractions of the loose material in another separator (15), directing the most dusty fractions of the loose material, lifted up by the air, to the expanded cascade separator (16), directing the stream to the area of adjustable cascades (17), that create a shutter, adjusting an angle of the shutter appropriately, removing the largest, isolated fractions of the loose material, that were moved downwards through the regulation valve 13", to the magnetic separator or to the external tank 14".

9. The method for cleaning and fine-sorting grain metallurgical waste fines of the loose material according to claim 8, further consisting of directing the hovering, lightest fractions of the loose material from the expanded cascade separator (16) to a cyclone dust collector (18), removing the lightest fractions of the loose material from the cyclone dust collector (18)

to a magnetic separator or directly to the external tank (14'''), through the regulation damper (13'''), as another fraction of isolated metallurgical waste of the loose material, wherein the regulation damper (13''') is closed during operation of the cyclone dust collector (18).

10. A device for cleaning and fine sorting grain of fine metallurgical waste fines in the form of loose material, composed of a feeding tank (1) connected to a feeding mechanism (2) for loose material, with a vertically oriented initial separator (3), into which air is blown by means of a fan (4), and with bottom part of the initial separator (3) connected by means of an ascending pipeline with a cascade separator (8), wherein in the middle part of the cascade separator (8) there is a bumper (11) with cascades (12) located above and under the bumper (11), the cascades (12) are arranged askew and in a certain distance from each other, whilst in the bottom part of the cascade separator (8) there is a regulation damper (13), through which the larger fractions of a cleaned loose material are discharged to a magnetic separator and later to an external tank (14) or directly to the external tank (14), whereby the upper part of the cascade separator (8) is connected to a filter, into which the lighter, hovering fractions of cleaned loose material are introduced, and the end element of the apparatus is an outlet optionally connected with a fan or a suction pump, characterised in that the ascending pipeline is a cascade pipeline (7), wherein individual sections (9) of the cascade pipeline (7) are of different diameter or are not arranged coaxially or are equipped with cascades or are of spiral shape, and wherein both the upper part of the initial separator (3) and the upper part of the cascade separator (8) are connected by means of ducts to a collector (6), into which the lightest, dusty fractions of loose material, isolated in the initial separator (3) and in the cascade separator (8) are introduced, and wherein the lightest fractions of the loose material are directed to a next cascade separator (15), in its bottom part there is a regulation damper (13'); by means of which the air is sucked in and the finest fractions of the loose material are lifted up; next by means of this damper, the coarser fraction of the loose material is introduced and is poured to the magnetic separator and then to the external tank (14'), or possibly directly to the external tank (14').

11. The device according to claim 10, wherein the next cascade separator (15) is connected with an expanded cascade separator (16), which has an area of adjustable vertical cascades (17), creating a shutter, wherein the angle of the shutter is adjustable, the stream of cleaned fine of the loose material introduced to the expanded cascade separator (16) from the next cascade separator (15) goes to the shutter.

12. The device according to claim 11, wherein the cascade separator (16) is connected with a cyclone dust collector (18), into which a stream of fine waste of the loose material is introduced from the expanded cascade separator (16), in the bottom part of the cyclone dust collector there is a regulation valve (13'''), through which additional air can be sucked from outside and through which larger fractions of the loose material are removed to the magnetic separator and to the external tank (14'''), or directly to the external tank (14''').

13. The device according to claim 10, wherein the device is equipped with at least one additional separator in the form of an additional cascade separator or with an additional cyclone dust collector (18).

14. A method for cleaning and fine-sorting grain of the loose material consisting of feeding in loose material from a feeding tank (1) by means of a feeding mechanism (2) to a vertically oriented initial separator (3), in the form of a cascade separator, and simultaneously to the inside of the initial separator (3) air is blown with a fan (4), through a regulation damper (13), creating positive pressure or overpressure inside the initial separator (3), speeding up particles of the material, blowing up the loose material, causing falling down the largest fractions of the loose material to the bottom of the initial separator (3), directing the largest fractions to the inside of the cascade separator (8), directly to a bumper (11) and cascades (12) located under and over the bumper (11), selecting the largest grain of the loose material removing while the grain that fell down by means of the regulation damper to the magnetic separator, or directly to an external tank, lifting up finest particles of the loose material with the air and removing the finest particles through an outlet, transporting the preselected loose material, accumulated on the bottom of the initial separator (3) with the stream of air to the cascade separator (8) through a cascade pipeline (7), breaking up and reducing where the clean and prepared loose material on the walls, wherein individual sections (9) of the cascade pipeline (7) are of different diameter or are not arranged coaxially or are equipped with cascades or are of spiral shape, directing the most dusty fractions of the loose material isolated in the initial separator (3) and in the cascade separator (8), lifted up with the air to a collector (6), and then to a next separator (15), dispersing and additionally breaking up loose the material in the next separator (15)

sucking up of lightest undesirable fractions of the material are to the top of the separator (15), removing the largest cleaned coarsegrained fractions of the loose material, which slide down, to the magnetic separator and to an external tank (14'), or directly to the external tank (14').

15. The method according to claim 14, further consisting of directing most dusty fractions of the loose material isolated in the next separator (15), lifted up by the air, to an expanded cascade separator (16), directing the stream an area of adjustable vertical cascades (17), that create a shutter, wherein the angle of the shutter is adjustable, removing the largest, isolated fractions of the loose material, that were transported downwards through a regulation valve 13", to the magnetic separator or to an external tank 14".

16. The method according to claim 15, further consisting of directing hovering, lightest fractions of the loose material from the expanded cascade separator (16) to a cyclone dust collector (18), and removing the lightest fractions of waste by means of a regulation damper (13'''), to a magnetic separator or directly to an external tank (14'''), as another fraction of the loose material, and the regulation damper (13''') is closed during operation of the cyclone dust collector (18).

* * * * *